US008561621B2

(12) United States Patent
Müller-Grünow et al.

(10) Patent No.: US 8,561,621 B2
(45) Date of Patent: Oct. 22, 2013

(54) HAIR COLORING AGENT APPLICATOR

(75) Inventors: Rolf Müller-Grünow, Köln (DE); Manuela Geuther, Ansbach (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 71 days.

(21) Appl. No.: 12/831,427

(22) Filed: Jul. 7, 2010

(65) Prior Publication Data

US 2011/0005546 A1 Jan. 13, 2011

(30) Foreign Application Priority Data

Jul. 7, 2009 (DE) ..... 10 2009 032 154

(51) Int. Cl.
*A45D 19/18* (2006.01)

(52) U.S. Cl.
USPC ..... 132/270

(58) Field of Classification Search
USPC ..... 132/112, 115–116, 74.5, 150, 207, 270, 132/228; 222/498, 517, 544–545, 559–561; 401/262
See application file for complete search history.

(56) References Cited

U.S. PATENT DOCUMENTS

| | | | | |
|---|---|---|---|---|
| 1,051,968 | A * | 2/1913 | Petrie | 222/470 |
| 1,462,167 | A * | 7/1923 | Perry Crooms | 132/117 |
| 1,951,079 | A * | 3/1934 | Zihlman | 15/220.4 |
| 2,463,611 | A * | 3/1949 | Green et al. | 132/108 |
| 3,030,968 | A * | 4/1962 | Oberstar et al. | 132/212 |
| 3,042,048 | A * | 7/1962 | Mostik | 132/149 |
| 3,963,147 | A * | 6/1976 | Waters | 222/95 |
| 4,108,184 | A * | 8/1978 | Morganroth | 132/273 |
| 4,209,027 | A * | 6/1980 | Morganroth | 132/212 |
| 4,961,439 | A * | 10/1990 | Hartmann | 132/212 |
| 5,059,050 | A * | 10/1991 | Guglielmo | 401/171 |
| 5,373,971 | A * | 12/1994 | Laffy et al. | 222/189.09 |
| 5,417,230 | A * | 5/1995 | Wood | 132/212 |
| 5,704,088 | A * | 1/1998 | Cerroni | 15/160 |
| 6,062,231 | A * | 5/2000 | De Laforcade | 132/145 |
| 6,510,856 | B1 * | 1/2003 | Ahn | 132/219 |
| 6,675,812 | B1 * | 1/2004 | Wiley | 132/108 |
| 6,752,157 | B2 * | 6/2004 | Lu Shao Hua | 132/109 |

(Continued)

FOREIGN PATENT DOCUMENTS

DE 4208415 A1 * 9/1993 ..... B65D 45/02

*Primary Examiner* — Robyn Doan
*Assistant Examiner* — Jennifer Gill
(74) *Attorney, Agent, or Firm* — Ingrassia Fisher & Lorenz, P.C.

(57) ABSTRACT

The present invention relates to an applicator (1) having an applicator element (8) for applying a product, conveyed to the application zone (5) from a separate reservoir, onto a strand of hair or of fibers comparable therewith, and having a strand gripper (12) movable back and forth between a closed position and a opened position. A strand gripper (12) of this kind serves to select and subsequently guide the hair or strands during actual product application. For improved guidance of the hair or strands during product application, the strand gripper (12) comprises a guidance surface (13) that, with the gripper (12) in the closed position, entirely overlaps the application zone (5) and holds the strand in contact with the application zone (5), by preference presses it onto the application zone (5).

16 Claims, 6 Drawing Sheets

(56) References Cited

U.S. PATENT DOCUMENTS

| | | | | |
|---|---|---|---|---|
| 7,025,069 | B2 | 4/2006 | Thiebaut | |
| 7,156,885 | B2 * | 1/2007 | Kennedy et al. | 8/405 |
| 7,770,586 | B2 * | 8/2010 | Tojo et al. | 132/222 |
| 7,866,326 | B2 * | 1/2011 | Mills et al. | 132/112 |
| 2003/0024544 | A1 * | 2/2003 | Thiebaut | 132/270 |
| 2006/0021629 | A1 * | 2/2006 | Mu et al. | 132/116 |
| 2008/0156339 | A1 * | 7/2008 | Moosmann | 132/116 |
| 2010/0037910 | A1 | 2/2010 | Müller-Grünow et al. | |

* cited by examiner

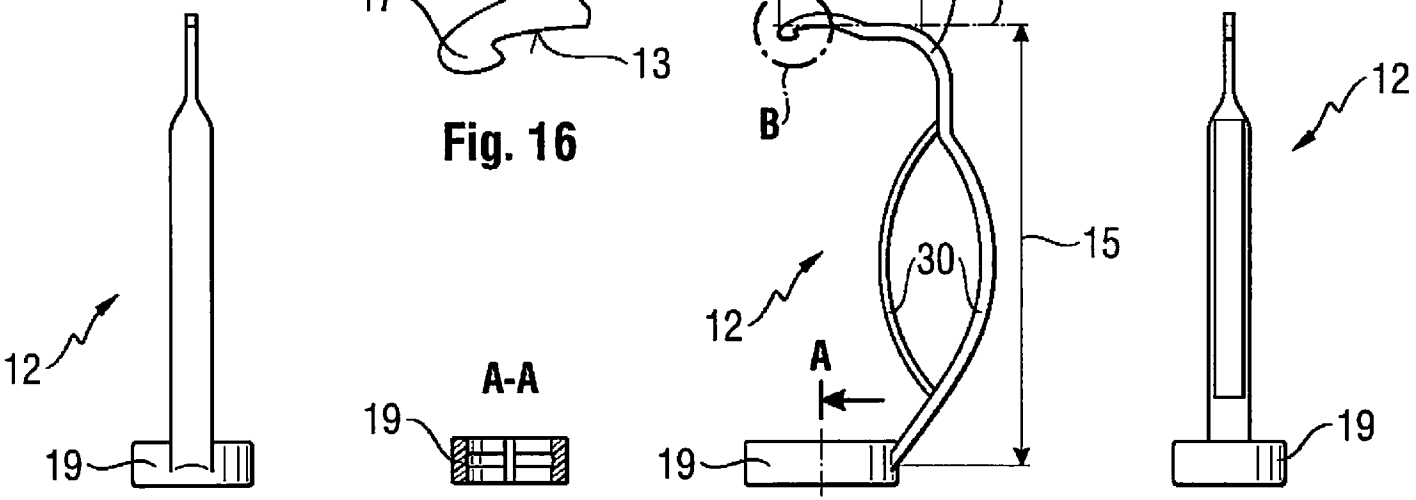
Fig. 13
Fig. 14
Fig. 15
Fig. 16
Fig. 17
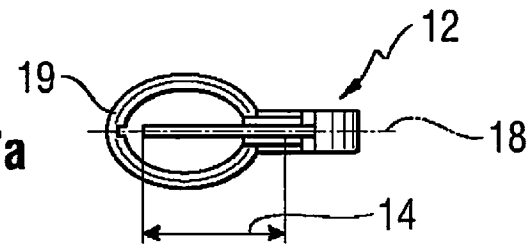
Fig. 17a

HAIR COLORING AGENT APPLICATOR

CROSS REFERENCE TO RELATED APPLICATIONS

The present application claims priority to German Patent Application No. 10 2009 032 154.3 filed 7 Jul. 2009.

The present invention relates to an applicator having an applicator element for applying a product conveyed to the application zone from a separate reservoir, onto a strand of hair or of fibers comparable therewith, and having a strand gripper movable back and forth between a closed position and an opened position. This strand gripper serves at least to guide a strand in the region of the application zone by means of a guidance surface provided on said gripper for that purpose. In many cases, however, it is also already used previously to select the strand and to bring the strand to the application zone.

A variety of concepts for applicators for the application of products onto hair strands or fiber strands are known in the existing art.

U.S. Pat. No. 3,030,968, for example, shows a forceps-like apparatus that can informally be called a strand forceps. With this strand forceps, the hair treating liquid or product which is applied is not conveyed to the application zone from a separate reservoir. Instead, the product is held in reserve in a trough directly in the application zone. To accomplish this, one side of the strand forceps comprises a depression such as a shell or trough into which the product is introduced before application begins. The other side of the strand forceps is equipped with a protrusion that is intended to penetrate into the depression.

With this strand forceps, application is accomplished by placing a hair strand over the depression and then closing the strand forceps. Doing so causes the protrusion to immerse the hair or hair strand into the depression and thus into the product contained therein. The strand can then be pulled lengthwise through the product contained in the depression, and is thereby immersed in the product.

It stands to reason that the strand forceps must be held as horizontally as possible during application in order to prevent the product kept in the depression of the strand forceps from pouring out. It is clear that this strand forceps is therefore relatively impractical, since when coloring hair at inaccessible locations such as the back of the head, it is difficult to hold the strand forceps consistently horizontal.

In addition, with this strand forceps it is not possible to meter in the amount of product applied onto the respective hair strand. This is because the treated hair strand is immersed completely into the product kept on hand in the depression. This does not present too great a problem as long as the product applied onto the hair strand has a watery consistency, since any excess product that the hair strand can not absorb runs off without further ado. However, this presents a problem in that the product running off drips into the surroundings instead of getting back into the depression.

Serious problems can occur, however, if the product applied onto the hair strand has a more highly viscous consistency, such as in more modern hair coloring agents which are often in the form of a paste or gel in order to prevent dripping of the product or uncontrolled wetting of the scalp by the product. Typically, far too much of such a product can be applied onto the hair strand if a strand forceps of this kind is used to apply the product, wherein the hair strand is immersed in undifferentiated fashion into the reservoir of product and is pulled through it.

Lastly, the strand forceps is also impractical because it is not possible to work continuously, but instead work needs to be repeatedly interrupted in order to refill the necessarily relatively small reservoir of product to be applied. Once application is complete, however, unused product still present in the depression must be disposed of, since it has already come into contact with the previously colored hair strands.

U.S. Pat. No. 7,025,069 shows a similar applicator. In contrast to the strand forceps described above, however, this involves not a forceps-like apparatus but a scissor-like one, that is, a strand scissors. The strand forceps and strand scissors are, however, very similar in terms of their operation and disadvantages so that what has been said above regarding the strand forceps also applies to the strand scissors.

Various applicators are further known from U.S. Patent Application Publication No. 2010/0037910.

A first exemplifying embodiment of this patent application is an applicator whose outer wall is elongated and serves as a so-called selection element. This selection element has an approximately C-shaped (and therefore not closed) cross section, with the result that it is quite bulky.

With this selection element, a hair strand can be grasped from the totality of the hair and delivered to the application region. The elongated part of the outer wall is configured for this purpose in that it comprises an oblique sliding surface that guides the grasped hair strand to a groove. The hair strand to be colored is laid into this groove in order to guide it past the paintbrush-like application element that serves here for application of the product or dye. The walls and bottom of the groove serve in this context as guidance surfaces that guide the hair strand and the applicator relative to one another when the hair strand slides through the application zone.

Operation using only one hand is, however, not possible with this exemplifying embodiment. This is because the groove is open, with one hand always required to hold the strand taut and keep it from slipping out of the groove, while the second hand needed in order to pull applicator along the strand.

In a second exemplifying embodiment proposed by this patent application, the region equipped with the groove that acts in guiding fashion is embodied displaceably, so that it is in fact possible to refer to a strand gripper which grasps a strand and actively brings it into close contact with the applicator (once again paintbrush-shaped in this case). With this exemplifying embodiment as well, however, the groove is open on one side so that the problems mentioned above still exist.

The patent application also provides for a third exemplifying embodiment.

With this third exemplifying embodiment, the region that is equipped with the groove is also embodied as a displaceable strand gripper. This exemplifying embodiment is improved so that in this case it is possible to push the groove of the strand gripper beneath a barb on the housing of the applicator whereby the grasped hair strand, delivered to the application zone by means of the groove, is caught securely between the groove and the barb. The groove, together with the barb, performs a guidance function, that is, it guides the hair strand and the applicator relative to one another while the applicator is pulled along the strand.

It is disadvantageous here, however, that only a part of the guidance surface is embodied on the movable strand gripper, while a not inconsiderable second part of the guidance surface is embodied on the barb mounted rigidly on the housing. The guidance surface of the strand gripper thus overlaps the application zone only partially. The strand gripper is therefore capable of bringing only that part of the strand remaining in its groove into intimate contact with the application zone or pressing it actively onto the application zone, while another not inconsiderable part of the strand slips into the groove that is constituted at a distance from the actual application zone and made available by the barb. There the relevant part of the strand comes into contact with the application zone much less intimately than the part of the strand that has remained in the groove of the strand gripper.

In view of this, in order to achieve a truly optimum result the user is advised to guide this applicator as well, whenever possible, along the strand so that on its path through the applicator, the strand slides almost completely in the groove of the strand gripper and does not escape upward into the groove formed by the barb. For this reason, this applicator also does not permit true one-handed operation, but requires increased attention during utilization.

Regardless, the risk remains that as the strand is delivered to the application region or as the strand is released again, a part of the strand may involuntarily become caught in the barb, resulting in unpleasant pulling on the hair, and moreover making the applicator uncomfortable to handle.

In the context of a fourth exemplifying embodiment, German Patent Application DE 10 2006 053 401 proposes equipping the applicator with a bent hook that protrudes far above the application region. This bent hook is said to serve to grasp the hair strand to be colored and thread it into the application region by the fact that the user slides said strand along the hook. The part of this hook facing the application region and a barb located opposite it are said to serve additionally to guide the hair strand in the application region during the application operation.

The structure that is used for this exemplifying embodiment is, however, not capable of holding the strand in direct contact with the application or even pressing it onto the application zone. This is because the hook and the barb associated with it are largely immovable, and in their rest position they enclose between themselves a space preceding the application zone and are therefore not capable of acting on the hair strand in the close-in region of the application zone. The guidance implemented by the hook and barb associated with it therefore more or less fails to prevent the strand from sliding laterally away from the application region while the applicator is pulled along the strand.

Here again, however, in order to achieve a truly good result, the user must take care to guide the applicator so that the hair strand remains constantly in intimate contact with the paintbrush that serves here as an application element.

The object of the present invention, in contrast, is to describe an applicator that avoids the aforementioned disadvantages.

This object is achieved with an applicator having an applicator element for applying a product, conveyed to an application zone (5) from a separate reservoir, onto a strand of hair or fibers, and a strand gripper (12), movable back and forth between a closed position and a opened position, that serves at least to guide a strand in the region of the application zone (5) by means of a guidance surface (13) provided on said gripper for that purpose. In particular, the strand gripper (12) is configured so that its guidance surface (13), in its closed position, substantially entirely overlaps the application zone (5) and holds the strand in direct contact with the application zone (5), by preference in fact presses it actively onto or against the application zone (5).

This conformation of the strand gripper usually makes possible true one-handed operation, at least subsequently to correct introduction of the strand into the application zone, in such a way that the applicator is held with one hand and is guided so that the strand slides along its longitudinal direction through the application zone. Because of its further configuration, the strand gripper that entirely overlaps the application zone ensures that the strand also remains constantly in direct contact with the application zone or is in fact actively pressed onto the application zone without particular effort by the user.

One-handed operation of this kind allows very sensitive metering of the product onto the strand, specifically in the context of applicators used in connection with an associated reservoir container for the product to be applied. Product metering or delivery is accomplished in this context essentially by application of pressure onto the squeezable reservoir container. Thanks to the advantageous one-handed operation, the user can concentrate entirely on pressing onto the reservoir container exactly strongly enough that the desired quantity of product travels approximately continuously into the application zone.

In a preferred embodiment, provision is made that the strand gripper comprises a preferably integrated spring portion. This is configured so that under the influence of a compressive force applied by the user onto the strand gripper, said portion deforms in such a way that the strand gripper is transferred into its opened position. It is possible in this fashion to implement with simple means, preferably as a one-piece injection-molded part made in particular of plastic or metal, a strand gripper that at times operates automatically.

In the context of another preferred embodiment, provision is made that the spring portion is configured so that it deforms under the influence of the compressive force applied by the user in such a way that the portion of the strand gripper making the guidance surface available executes, in order to reach the opened position, a movement directed away from the application zone. A configuration of this kind makes it possible, particularly conveniently, to grasp the next strand provided for application, since the aforesaid portion of the strand gripper can slide behind a hair strand with no need to guide the reservoir container together with the applicator, or the handle of the applicator alternatively supplied by means of a metering pump, parallel to the head of the customer whose strands are to be colored.

The applicator element preferably carries, in the region of its opening, directing elements or directing surfaces which prevent a strand, pulled in its longitudinal direction over the opening, from sliding into a region outside the opening. These usually rigidly mounted directing surfaces assist the action of the guidance surface of the strand gripper, since they are complementary to the strand gripper in terms of their action. This is because the strand gripper has certain difficulties in preventing individual hair tufts of a strand from slipping in a lateral direction out of its region of influence. The directing surfaces, which specifically prevent this, are useful here.

In the context of a further preferred embodiment, the applicator element comprises an opening in the region wherein it carries support elements or is equipped with support surfaces against which the gripper section can support itself under the influence of the frictional forces that are exerted on it by a strand pulled in its longitudinal direction over the opening. A configuration of this kind allows the portion of the strand gripper that makes the guidance surface available to be embodied in particularly delicate fashion so as thereby to constitute an optimally handleable strandlet needle, with no need to worry about weakening that portion so greatly that it deforms, as the strand is pulled, so much that its function is called into question.

According to a further alternative applicator variant, it is useful to provide in the region of the application zone an application element that is in fluid connection with the opening. An application element of this kind ensures improved, in particular more uniform, product application. For that purpose, the application element is preferably configured in such a way that it is capable of absorbing and storing specific quantities of product in order then to apply them uniformly onto the hair or strands to be treated. The application element can be configured in particular in the manner of a paintbrush, bristle brush, or sponge, in the form of a sintered element, or in comparably porous fashion, so that product can be easily absorbed and stored.

Further preferred embodiment possibilities, advantages, and modes of operation may be gathered from the description, undertaken below with reference to numerous Figures, of two exemplifying embodiments of the applicator according to the present invention.

BRIEF DESCRIPTION OF THE DRAWINGS

FIGS. 13 to 17*a* are isolated depictions, seen from various viewing angles, of the strand gripper as used for the first exemplifying embodiment.

Figure 1:
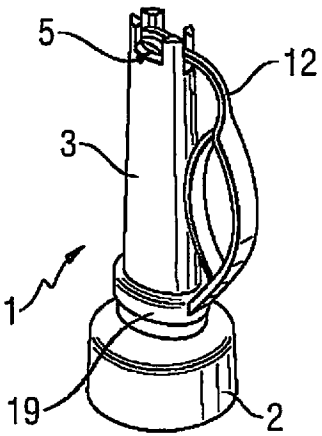
FIG. 1 is a perspective view of a first exemplifying embodiment of the applicator according to the present invention.
Figures 7, 8, 9, 10, 11, 12:
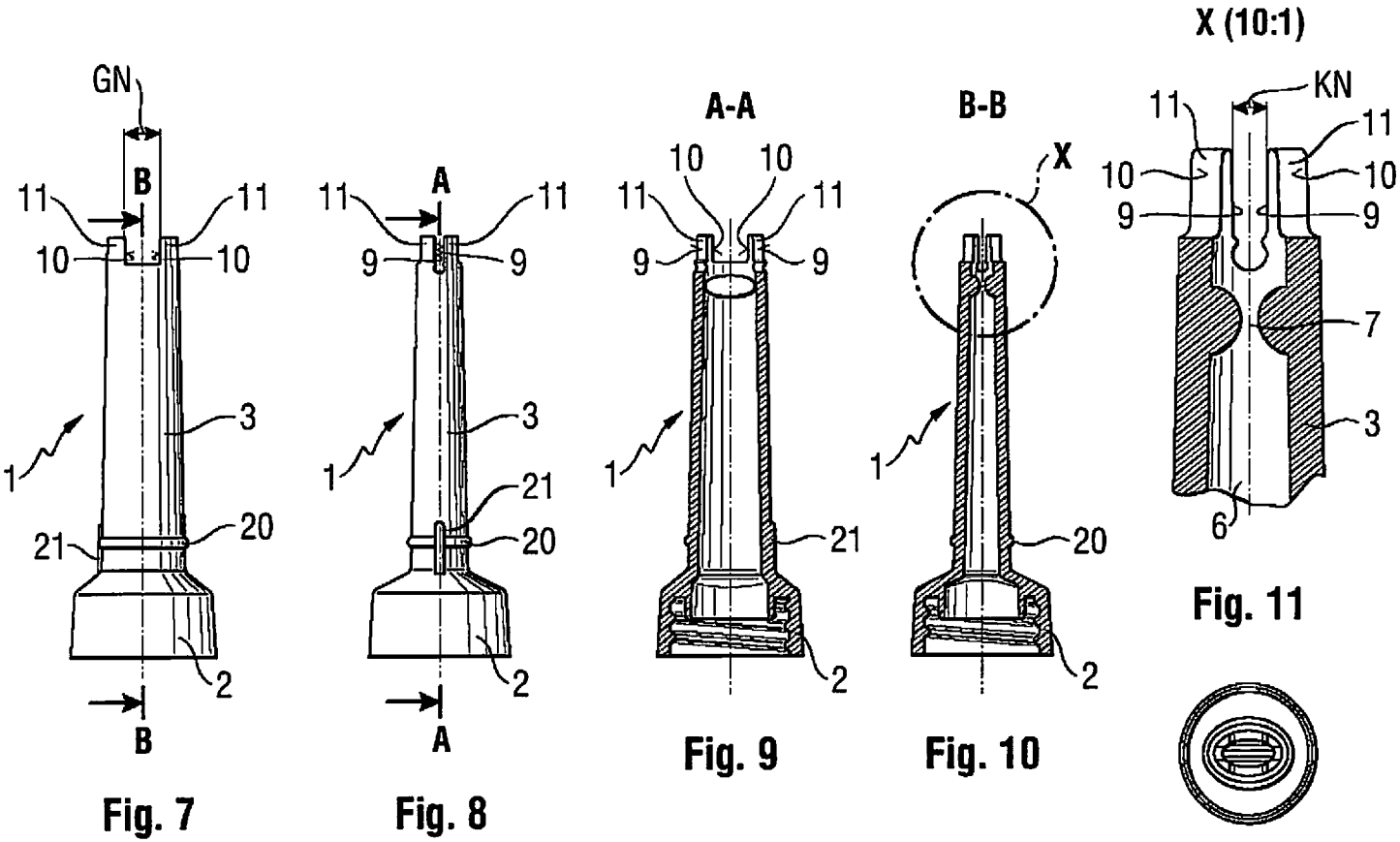
FIG. 7 is a front view, in an isolated depiction, of the applicator element as used for the applicator in accordance with FIG. 1.
FIG. 8 is a side view of the applicator element shown in FIG. 7.
FIG. 9 is a section through the applicator element shown in FIG. 8, along section line A-A marked in FIG. 8.
FIG. 10 is a section through the applicator element shown in FIG. 7, along section line B-B marked in FIG. 7.
FIG. 11 shows detail X from FIG. 10.
FIG. 12 is a plan view, vertically from above, of the applicator element shown in FIGS. 7 and 8.
Figure 20:
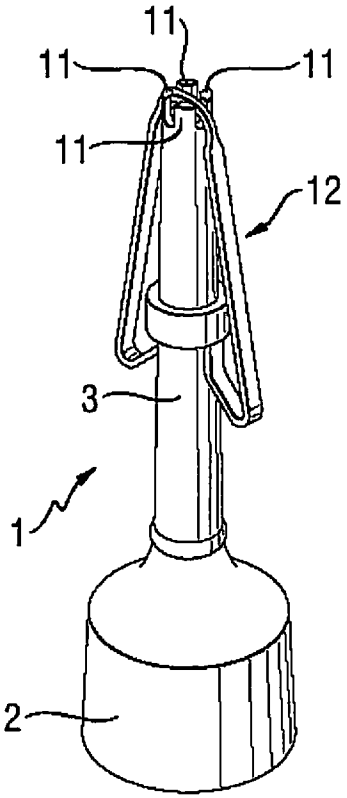
FIGS. 18 to 20 show a second exemplifying embodiment of the invention, seen from various viewing angles, with the strand gripper closed.
Figure 19:
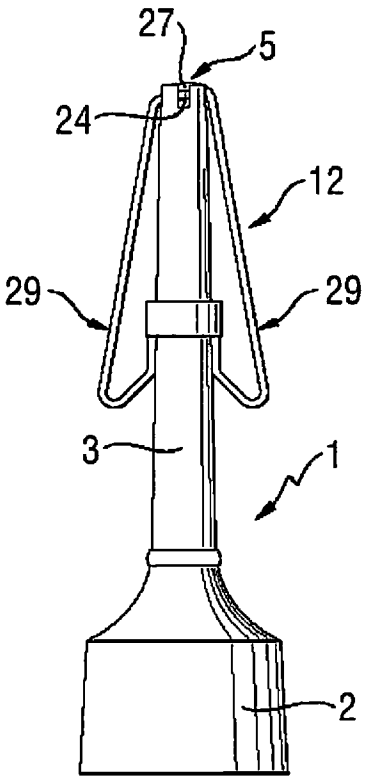
Figure 18:
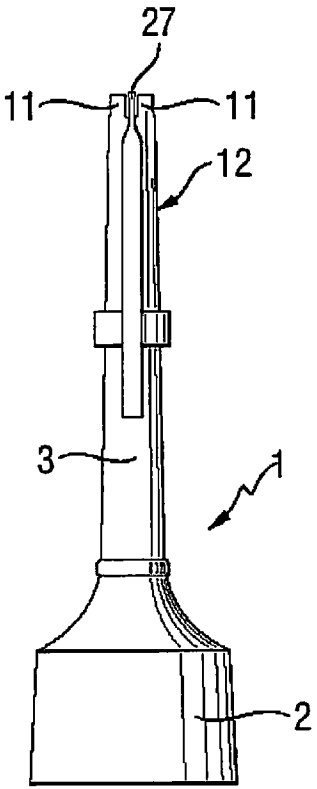

As already indicated, FIG. 1, with reference to which the description will now begin, shows an applicator 1 in accordance with a first exemplifying embodiment of the invention.

Applicator 1 shown here is suitable for coloring fine strands of fiber or hair (or "strands of keratinic fibers") whose diameter is less than 1.5 millimeters and usually approximately 0.5 millimeter.

An applicator 1 of this kind is preferably in fluid connection with a reservoir container (not shown here) typically fabricated from plastic. Applicator tip or element 8 shown by FIG. 1 is placed onto the reservoir container that can be bottle- or tube-shaped. Located in said reservoir container is a large reservoir of the product to be applied onto the hair strand. In use, the product to be applied is guided through applicator element 8 that is of internally hollow configuration, so that it is possible to work on the whole continuously (i.e., without substantial interruption) with applicator 1.

Applicator 1 comprises, on its side facing toward the reservoir container, a connector 2 for detachably connecting applicator 1 to the associated reservoir container. Connector 2 preferably encompasses a thread for screw connection with the reservoir container. Instead of a thread, the applicator element can also be connected to the reservoir container bottle by means of a comparably acting connection method (e.g., a snap-on or press connection).

Adjoining connector 2 is a substantially tubular functional portion of applicator element 8 that forms a tubular nozzle 3. The hollow nozzle 3 preferably has a circular or elliptical cross section and thus forms an internally located channel 6 for the product.

By way of this nozzle 3, the product stored in the reservoir container is directed inside applicator element 8 and delivered to an opening 4 integrated into the free end of nozzle 3.

Figure 4:
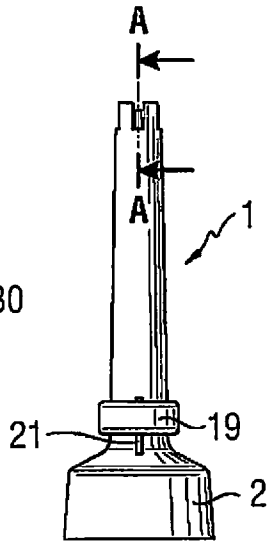
FIG. 4 is a side view, seen from the side located opposite the strand gripper, of the applicator in accordance with FIG. 1.
Figure 3:
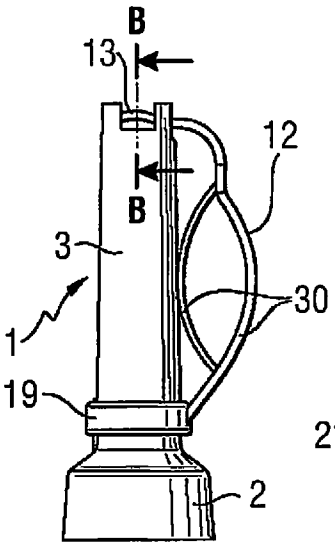
FIG. 3 is a front view of the strand gripper in accordance with FIG. 1.
Figure 2:
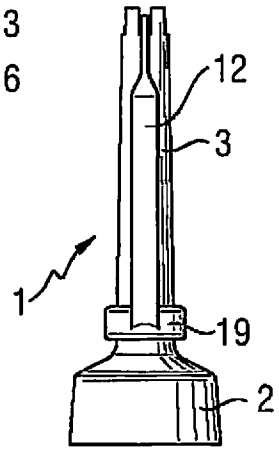
FIG. 2 is a side view, seen from the side of the strand gripper, of the applicator in accordance with FIG. 1.
Figure 6:
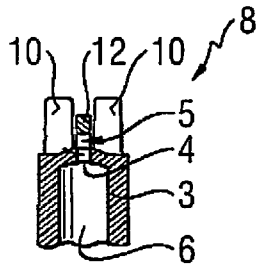
FIG. 6 is a detail view of the section that was taken along the line marked in FIG. 3.
Figure 5:
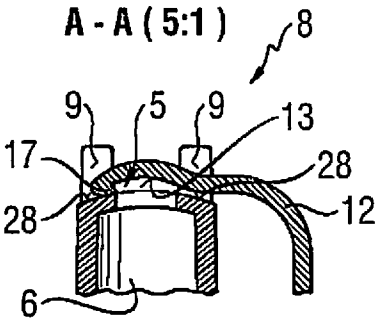
FIG. 5 is a detail view of the section that was taken along the line marked in FIG. 4.

FIGS. 5 and 6 show a cross-section through the region of opening 4 at the free end of applicator element 8 or of its nozzle 3, and, together with FIGS. 1 to 3, illustrate the details of applicator element 8. Opening 4 serves here, very generally, to discharge the product out of applicator element 8 into an application zone 5 external to applicator element 8 adjacent to opening 4. Actual application of the product onto the hair or strands then occurs inside application zone 5.

The product to be applied is brought to application zone 5 via the internally located channel 6 from the reservoir in the reservoir container, and then emerges through opening 4 of internally located channel 6 into the application zone. As illustrated in FIGS. 5 and 6, opening 4 of internally located channel 6 is located approximately at the center of sliding surface 28 (looking in the direction in which the respective hair strand is pulled through the application zone). Opening 4 is embodied here as a wide slot, and has a cross section that is reduced compared to the adjacent portion of internally located channel 6. This prevents an excessive quantity of product from being immediately applied in the event of greater pressure on the reservoir container.

One part of the product that is to be applied and that emerges from opening 4 penetrates directly into the strand immediately after emerging from opening 4, and another part (assuming a correspondingly high viscosity) is dragged along by the surface of the strand in the direction of sliding surface 28 and comes into intimate contact with the strand in the course thereof. A further improvement, particularly with respect to more uniform product application, can additionally be achieved by using an application element (not shown) inside application zone 5.

Guidance surface 13 of strand gripper 12 overlaps application zone 5 in a direction transverse to the direction in which the strand is pulled through applicator 1, and ensures in this fashion that the strand remains in sufficient contact with application zone 5. By preference, guidance surface 13 presses the strand onto application zone 5 or onto opening 4 through which the product to be applied emerges. In this exemplifying embodiment, guidance surface 13 of strand 12 extends in a direction substantially or almost exactly perpendicular to the longitudinal axis of internally located channel 6 and/or of nozzle 3, both when strand gripper 12 is opened and when strand gripper 12 is closed.

The free end of applicator 1 or its nozzle 3 is equipped behind opening 4 (looking in the flow direction) with directing surfaces 10 and support surfaces 9. In the case of the exemplifying embodiment described here, directing and support surfaces 9, 10 are located on crenellation-like elements 11 that impart to the free end of applicator element 8 the appearance of a castle tower. Four of these crenellation-like elements 11 are provided. They enclose between them a first, usually large groove GN in a first direction and (optionally) a second, usually smaller groove KN in a second direction.

First groove GN receives the hair strand to be pulled through application zone 5. The hair strand is held in contact with application zone 5 by strand gripper 12. Directing surfaces 10 that laterally delimit first groove GN reliably prevent parts of a hair strand from escaping from the effect of guidance surface 13 of strand gripper 12, and slipping laterally out of application zone 5, under the influence of the forces that occur as the hair strand is pulled through application zone 5.

In its closed state, strand gripper 12 rests in second groove KN. Second groove KN supports strand gripper 12 by means of support surfaces 9 that delimit said groove. The result is that even if strand gripper 12 is configured in extremely slender fashion for the sake of better handling, strand gripper 12 is preopened from being undesirably carried along or warped in the longitudinal direction of the hair strand under the influence of the forces that occur as the hair strand is pulled through application zone 5.

Strand gripper 12 used by this first exemplifying embodiment is made up of a first functional portion 14, a transitional portion 16 (not further explained) adjacent thereto, and adjacent to the latter in turn a second functional portion 15 that can be configured as a spring element.

This first functional portion 14 constitutes a guidance surface 13 that, with strand gripper 12 in the closed position, entirely overlaps application zone 5 transversely to the pull-through direction and, as already mentioned, ensures that the strand remains in sufficient contact with application zone 5. Guidance surface 13 preferably presses the strand onto application zone 5 or onto opening 4 through which the product to be applied emerges, as depicted in FIGS. 5 and 6.

First functional portion 14, 24 is embodied in very slender fashion, usually as slender as permitted by the material used (e.g., plastic or metal) and by the forces expected during use, without producing disruptive deformation of said portion. As a rule, it has a closed round or rectangular or polygonal cross section. Its largest diameter is as a rule smaller by a factor of ten than its length in the direction of longitudinal axis 18, and as a rule is less than 10 mm, ideally less than 7 mm. As shown by FIGS. 1, 2, 22 and 26, its width is furthermore smaller by a factor of about three than that of second functional portion 15. First functional portion 14, 24 carries in the region of its free end a barb 17. First functional portion 14, 24 is thus configured as a strandlet needle.

Longitudinal axis 18 of first functional portion 14, 24 extends substantially perpendicular to the longitudinal axis of applicator element 1 and nozzle 3. In this fashion, when applicator 1 is utilized as intended, the bottle-shaped reservoir container is positioned substantially perpendicular to the hair or strand on which application is being performed, and thus presents as little impediment as possible. The region of first functional portion 14 that comes to rest over application zone 5 in the closed position is preferably curved in such a way that it adapts to the outer contour of the oppositely located sliding surface 28.

The second functional portion 15 of strand gripper 12 forms a spring element 30 integrated into strand gripper 12. This element is supported here against the nozzle 3. In order to enable true one-handed operation of the entire applicator 1, the nozzle 3 is preferably dimensioned so that it forms an abutment that does not appreciably deform under the influence of the unilaterally acting forces that normally occur (i.e., it requires no further support by the user).

The integrated spring element 30 elongates under the influence of a compressive force acting on spring element 30, and thereby lifts first functional portion 14 away from application zone 5. Embodied for this purpose on second functional portion 15 are two leaf springs 30 arranged in opposite directions, which are curved so that they elongate together under the influence of a compressive force. With a corresponding design, a correspondingly stiff configuration of applicator element 1, and ergonomic dimensioning of the reservoir container, these leaf springs 30 can be compressed using only a single finger of the hand holding the entire applicator 1, preferably using the thumb or index finger. Strand gripper 12 thus permits true one-handed operation.

As a consequence of this elongation, first functional portion 14 is moved substantially transversely to its longitudinal axis 18 and thus away from application zone. Its stroke length (by preference 1 to 3 cm) is selected to be sufficient so that first functional portion 14 is lifted far enough away from application zone 5 that the portion can be used conveniently as a strandlet needle (i.e., it can be used to grasp behind a new hair strand that will be colored in a subsequent step and divide it up). For this purpose, the correspondingly configured first functional portion 14 is used as a kind of hook to grasp behind the hair strand at an angle of approximately 70° to 130°, based on its own longitudinal axis and the longitudinal axis of the hair strand to be grasped. Barb 17 makes it easier to divide up a strand and subsequently prevents the hair strand grasped by first functional portion 14 from unintentionally sliding off laterally over the free end of first functional portion 14.

As soon as the pressure on spring element 30 is released, it pulls the first functional portion 14 back into its closed position. In that context, first functional portion 14 entrains the hair strand in contact against its guidance surface 13 and brings it into direct contact with application zone 5. In the concrete exemplifying embodiment, spring element 30 is configured so that it is still under a certain tension even when the hair strand delivered by guidance surface 13 has already ended up in application zone 5. The result is that the hair strand not only is held in substantially zero-clearance fashion in application zone 5, but also is actively pressed into application zone 5.

On its side facing away from first functional portion 14, strand gripper 12 is equipped with a holding member 19 configured here in annular fashion. This holding member 19 is pushed over applicator element 8 or its nozzle 3 and fastened there, by preference latched on, for example on ridge 20 provided for that purpose on nozzle 3. Holding member 19 and nozzle 3 are preferably configured so that holding member 19 can be secured correctly on nozzle 3 in only one specific orientation. This is ensured, in the present exemplifying embodiment, by a kind of feather key 21. In any event, holding member 19 can be secured nonrotatably on nozzle 3. The possibility thus exists of equipping nozzle 3 as necessary with differently configured strand grippers 12, or also of deciding to use nozzle 3 without having previously installed a strand gripper 12. This increases acceptance specifically for applicators 1 that are intended for ordinary consumers, since the consumer can use applicator 1 in the manner that he or she finds most appropriate.

It must be remembered that applicator 1 does not necessarily have to be used in connection with a (in particular, bottle-shaped) reservoir container. Applicator 1 shown by FIG. 1 can instead, for example, be threaded onto a handle that is supplied, via a flexible supply line and metering pump, with the product kept on hand at an entirely different location. It then bears an approximately and purely external resemblance to, for example, an airbrush handpiece, but with the difference being that the product to be applied is delivered not pneumatically in accordance with the venturi principle, but by pumping the product to be applied.

Regardless of how applicator 1 is utilized, it is generally advisable, for reasons of hygiene and maximally simple use, to embody applicator 1 as a disposable item (i.e., as a single-use product). The invention accomplishes this thanks to its very simple configuration.

FIGS. 13 to 28 show a second exemplifying embodiment of applicator 1 according to the present invention that is also designed for coloring fine strands of fiber or hair (or "strands of keratinic fibers") whose diameter is less than 1.5 millimeter and is usually approximately 0.5 millimeter.

Applicator 1 described in the context of this second exemplifying embodiment differs from that of the first exemplifying embodiment only in terms of its strand gripper 12. The complete applicator element 8, in contrast, corresponds substantially to that of the first exemplifying embodiment, so that what has already been said in that regard also applies in the context of the second exemplifying embodiment.

As may be explained with reference to FIG. 22, strand gripper 12 of this second exemplifying embodiment is made up of two gripper arms 29. One of these two gripper arms 29 comprises, in a closed position, an internally located first functional portion 24, a transitional portion 25 adjacent thereto, and adjacent to the latter in turn a second functional portion 26 that constitutes a spring. Internally located functional portion 24 constitutes guidance surface 13 which, with strand gripper 12 in a closed position, entirely overlaps application zone 5 transversely to the pull-through direction of the strand and holds the strand in direct contact with application zone 5. Longitudinal axis 18 of internally located first functional portion 24, or at least of guidance surface 13 of the strand gripper (see FIG. 27), extends substantially perpendicular to the longitudinal axis of applicator 1 or of nozzle 3 when the strand gripper is closed.

The other of these two gripper arms 29 comprises a first functional portion 27 that is externally located in a closed position, a transitional portion 25 adjacent thereto, and adjacent to the latter in turn a second functional portion 26 that likewise constitutes a spring. The two springs of second functional portions 26 are supported against the corresponding nozzle 3, but as a rule are arranged relative to one another so that the forces F exerted by them on nozzle 3 cancel each other out, making superfluous any particularly sturdy configuration of nozzle 3.

Figures 21, 22, 23, 24:
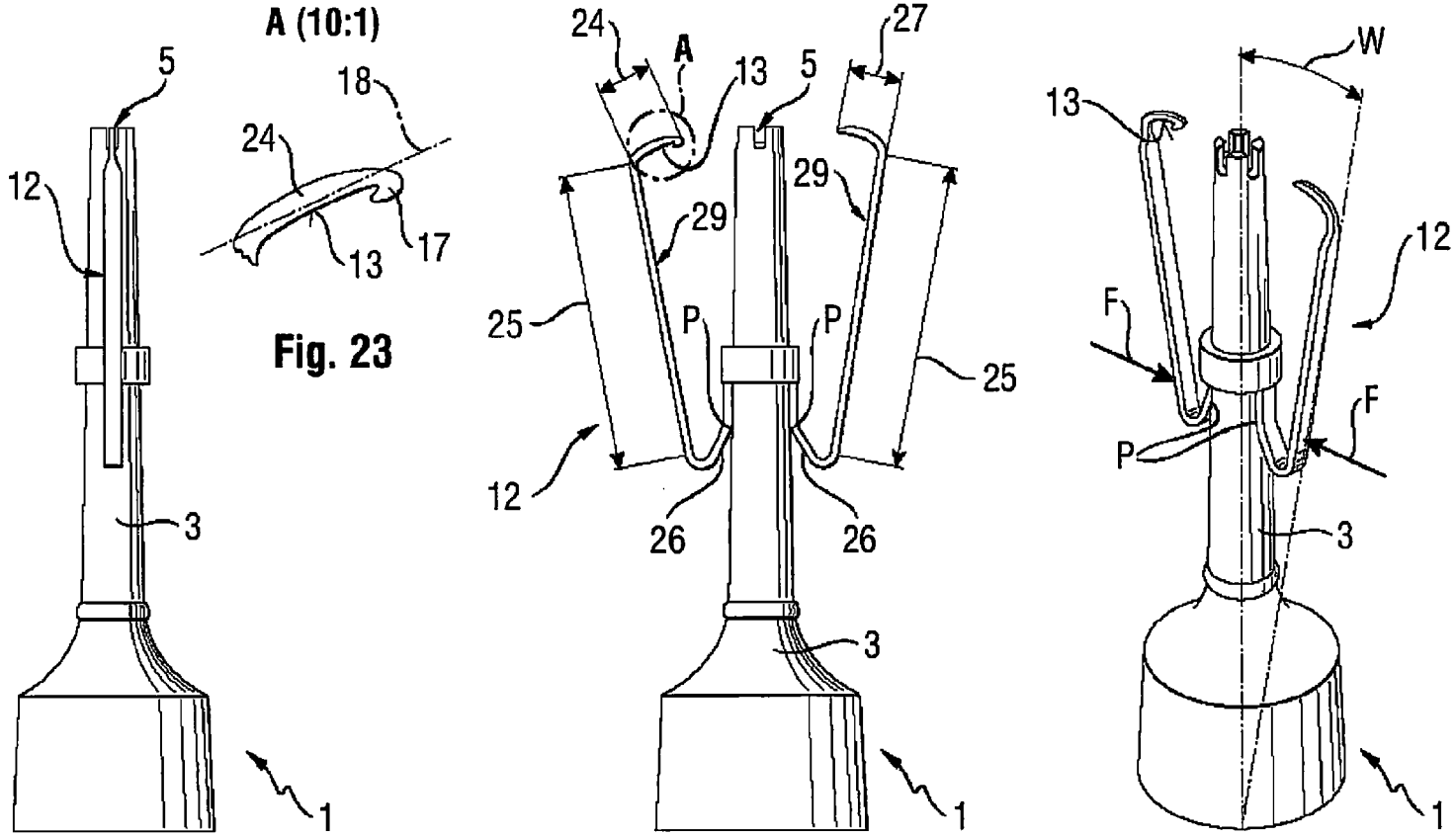
FIGS. 21 to 24 show the second exemplifying embodiment of the invention, seen from various viewing angles, with the strand gripper open.
Figure 28:
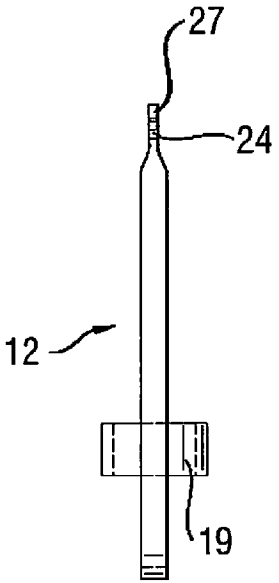
FIGS. 25 to 29 are isolated depictions, seen from various viewing angles, of the strand gripper as used for the second exemplifying embodiment.
Figure 26:
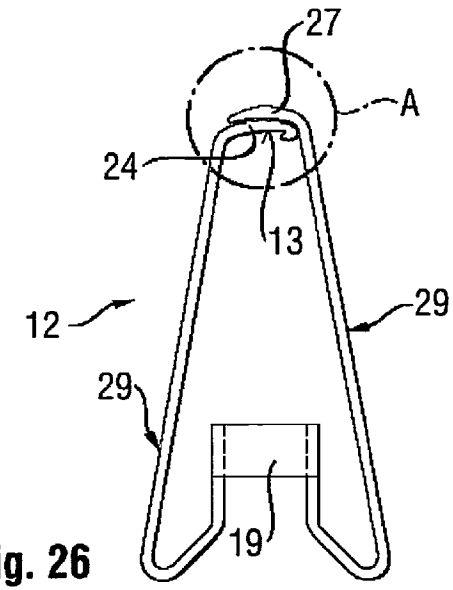
Figure 29:
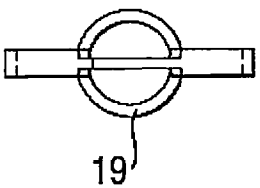
Figure 27:
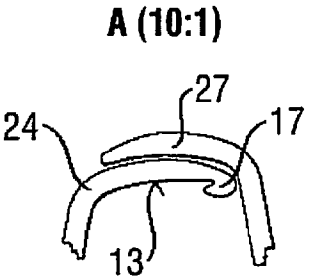
Figure 25:
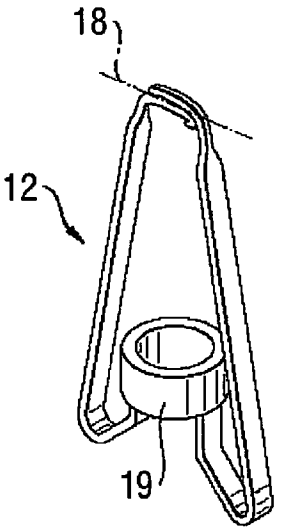

The two springs 26 are designed so that the two transitional portions 25 pivot in butterfly fashion outward, about or in the region of points P, with their first functional portions 24 and 27 when a respective compressive force F is exerted onto the two transitional regions 25 in the region in which the latter overlie second functional portions 26 (see FIG. 24, arrows F). Springs 26 and gripper arms 29 are preferably designed so that the gripper arms pivot outward, with respect to the longitudinal axis of the applicator element or of its nozzle 3, through an angle W of approximately 5° to 15° (again, see FIG. 24). With suitable dimensioning of strand gripper 12 and with a reservoir container configured in correspondingly easily gripped fashion, the compressive forces indicated by arrows F can be applied by the fact that the user's thumb applies the first compressive force, and the index finger the second compressive force, while the remainder of the user's hand holds onto the reservoir container. Convenient one-handed operation of applicator 1 is thus ensured with this embodiment as well.

The first, internally located, functional portion 24 is embodied in very slender fashion, usually as slender as permitted by the material used and by the forces expected during use, without producing disruptive deformation of said portion. As a rule, it has a closed round or rectangular or polygonal cross section. Its largest diameter is as a rule smaller by a factor of five than its length in the direction of longitudinal axis 18 (see, e.g., FIG. 18, 20, 23, or 25), and as a rule is less than 10 mm, ideally less than 7 mm. As the Figures likewise illustrate, its width (in a direction transverse to its longitudinal axis 18) is furthermore smaller by a factor of about three than that of transitional portion 25 or the remainder of the arm. The first internally located functional portion 24 usefully possesses a rectangular cross section. The first internally located functional portion 24 carries in the region of its free end a barb 17 (see especially FIG. 23).

The first internally located functional portion 24 is thus once again configured as a strandlet needle. It is intended to grasp behind a new hair strand that will be colored in a subsequent step and divide it up. For this purpose, the correspondingly configured first functional portion 24 is used as a kind of hook to grasp behind the hair strand at an angle of approximately 70° to 130°, based on its own longitudinal axis and the longitudinal axis of the hair strand to be grasped. Barb 17 makes it easier to divide up a strand, and subsequently prevents the hair strand grasped by first functional portion 24 from unintentionally sliding off laterally over the free end of first functional portion 24.

As soon as the hair strand selected for the next application operation is placed onto internally located functional portion 24 used as a strandlet needle, or is resting against its guidance surface 13, the user terminates pressure on transitional portions 25. Under the influence of the spring force, gripper arms 29 now pivot back into their closed position. Internally located first functional portion 24 carries the selected hair strand along and places it into application zone 5 brings it into direct contact with application zone 5). In that context, internally located functional portion 24 distributes the hairs or hair tufts of the strand in a certain fashion over application zone 5, since it progressively sweeps over application zone 5 from outside to inside until it reaches its completely closed position.

During all of this, externally located first functional portion 27 pivots over internally located functional portion 24 and supports it on its side facing away from the strand, so that internally located first functional portion 24 is not substantially bent up even if larger forces happen to act in the course of the utilization of applicator 1, on internally located functional portion 24 or its guidance surface 13 in the direction of the longitudinal axis of applicator 1 or its nozzle 3. By preference, the outer contact surface of internally located functional portion 24 is embodied in convex fashion, and the internal contact surface of the externally located functional portion in concave fashion, so that a locking action in the pivoting direction in fact results because of the friction between the two functional portions 24 and 27.

With this exemplifying embodiment as well, strand gripper 12 is equipped on its side facing away from first functional portions 24 and 27 with a holding member 19 that can be configured annularly. This holding member 19 is slid over applicator element 8 or its nozzle 8 and fastened there. The holding member of this second exemplifying embodiment is embodied in the manner already set forth for the corresponding holding member of the first exemplifying embodiment.

This second variant of applicator 1 can of course also be equipped additionally, in application zone 5, with an application member already mentioned.

LIST OF REFERENCE CHARACTERS

1 Applicator
2 Connection element
3 Nozzle
4 Opening
5 Application zone
6 Channel
8 Applicator element
9 Support surface
10 Directing surface
11 Crenelation-like element
12 Strand gripper
13 Guidance surface of strand gripper
14 First portion of strand gripper (first exemplifying embodiment)
15 Second, resilient portion of strand gripper (first exemplifying embodiment)
16 Transitional portion
17 Barb
18 Longitudinal axis of first portion
19 Holding member
20 Ridge
21 Feather key
24 First functional portion (first arm of second exemplifying embodiment)
25 Transitional portion (first and second arm of second exemplifying embodiment)
26 Second functional portion (first and second arm of second exemplifying embodiment)
27 First functional portion (second arm of second exemplifying embodiment)
28 Sliding surface
29 Gripper arm
30 Spring element
GN Large groove
KN Small groove
W Pivoting angle
F Force

We claim:

1. Applicator comprising:

an applicator element for applying a product onto a strand of hair or fibers, wherein the product is conveyed to an application zone from a separate reservoir, and a strand gripper movable back and forth between a closed position and an opened position, that serves at least to guide a strand in the region of the application zone by a guidance surface provided on the gripper for that purpose, the strand gripper having a first functional portion having the guidance surface and a second functional portion, the first functional portion having a width smaller than a width of the second functional portion, the first functional portion having a longitudinal axis that extends substantially perpendicular to a longitudinal axis of the applicator element when the strand gripper is in its closed position, and the second functional portion having a longitudinal axis that extends substantially parallel to the longitudinal axis of the applicator element, wherein the strand gripper comprises at least one integrated spring portion that, under the influence of a compressive force applied by the user onto the gripper, deforms in such a way that the strand gripper is transferred into its opened position, and wherein the integrated spring portion comprises two oppositely disposed leaf springs, wherein when the gripper is in the closed position, the guidance surface overlaps the application zone and holds the strand in contact with the application zone, pressing it onto the application zone, and wherein the applicator is securable to the separate reservoir.

2. Applicator according to claim 1, wherein the at least one spring portion and the strand gripper are configured so that the compressive force necessary for transferring the strand gripper into the opened position can be applied by the user using the same hand that is also holding the applicator.

3. Applicator according to claim 1, wherein the spring portion is configured so that when a user applies compressive force, the spring portion deforms so that the first functional portion of the strand gripper that makes the guidance surface available moves, in order to reach the opened position, substantially away from the application zone.

4. Applicator according to claim 3, wherein the first functional portion that makes the guidance surface available carries a barb in the region of its free end.

5. Applicator according to claim 1, wherein the first functional portion of the strand gripper that makes the guidance surface available forms a strandlet needle wherein, with the strand gripper in the opened position, it is possible to engage behind an individual strand in order to select it and convey it to the application zone.

6. Applicator according to claim 5, wherein the first functional portion of the strand gripper that makes the guidance surface available tapers with respect to the second functional portion of the strand gripper adjacent thereto.

7. Applicator according to claim 5, wherein the first functional portion of the strand gripper that makes the guidance surface available is configured as a strandlet needle whose maximum cross-sectional diameter is substantially smaller than its extension in the direction of its longitudinal axis.

8. Applicator according to claim 1, wherein the strand gripper comprises an annular holding collar by means of which it can be slid over a tubular portion of the applicator element and fastened there.

9. Applicator according to claim 1, wherein the applicator element further comprises an opening through which the product is delivered from the separate reservoir, the applicator element comprising, in the region of the opening, directing surfaces which prevent a strand, pulled in its longitudinal direction over the opening, from sliding into a region outside the opening.

10. Applicator according to claim 9, wherein the applicator element further comprises an opening through which emerges the product delivered from the separate reservoir, the applicator element further comprising, in the region of the opening between the directing surfaces, support surfaces against which the strand gripper can support itself under the influence of the forces that are exerted on it by a strand pulled in its longitudinal direction over the opening.

11. Applicator according to claim 1, wherein the applicator element further comprises a convex sliding surface externally surrounding an opening, wherein the strand slides along the sliding surface when the strand is pulled through the application zone.

12. Applicator according to claim 1, wherein the applicator element further comprises an internally located channel having an opening located in a sliding surface of the application zone.

13. Applicator according to claim 1, wherein the applicator element comprises an internally located channel through which the product to be applied is delivered from the separate reservoir, wherein a constriction acts in metering fashion in the region of an opening of the channel or wherein the opening itself acts as a constriction.

14. Applicator according to claim 1, wherein the applicator element comprises, in the application zone, an application element that is in fluid connection with an opening.

15. Applicator according to claim 1 wherein each leaf spring comprises a strand gripper and when both grippers are in their closed position, the first functional portions of the grippers are located adjacent one another.

16. Applicator according to claim 1, wherein the strand gripper is a one-piece part.

* * * * *